US009410782B2

(12) United States Patent
Bruno et al.

(10) Patent No.: US 9,410,782 B2
(45) Date of Patent: Aug. 9, 2016

(54) MULTI-ACTION FUZE AND WARHEAD SEPARATOR FITTED TO A MUNITION

(71) Applicant: NOSTROMO, LLC, Alexandria, VA (US)

(72) Inventors: Nicolas Horacio Bruno, Cordoba (AR); Kevin Michael Sullivan, Kennebunk, ME (US)

(73) Assignee: NOSTROMO HOLDINGS, LLC, Alexandria, VA (US)

( * ) Notice: Subject to any disclaimer, the term of this patent is extended or adjusted under 35 U.S.C. 154(b) by 6 days.

(21) Appl. No.: 14/683,319

(22) Filed: Apr. 10, 2015

(65) Prior Publication Data

US 2016/0131466 A1 May 12, 2016

Related U.S. Application Data

(60) Provisional application No. 61/981,298, filed on Apr. 18, 2014.

(51) Int. Cl.

| | |
|---|---|
| ***F42B 39/20*** | (2006.01) |
| ***F42C 15/34*** | (2006.01) |
| ***F42B 15/36*** | (2006.01) |

(Continued)

(52) U.S. Cl.

CPC ..... *F42C 15/34* (2013.01); *F42B 15/36* (2013.01); *F42B 39/14* (2013.01); *F42B 39/20* (2013.01); *F42C 15/44* (2013.01)

(58) Field of Classification Search

CPC ..... F42B 39/00; F42B 39/20; F42B 33/0278; F42B 15/36; F42B 39/14; F42C 15/34; F42C 15/44; F42C 15/36; F42C 19/02

USPC ..... 102/481, 202.1, 293; 220/89.4

See application file for complete search history.

(56) References Cited

U.S. PATENT DOCUMENTS 2,035,497 A * 3/1936 Morse ..... F16K 17/383 137/77

3,665,857 A * 5/1972 Radnich ..... F42B 39/00 102/481

(Continued)

FOREIGN PATENT DOCUMENTS

DE 4112595 A1 4/1991

OTHER PUBLICATIONS

European Search Report of Corresponding European Application No. EP15164129.7.

*Primary Examiner* — Jonathan C Weber

(74) *Attorney, Agent, or Firm* — Karl F. Milde, Jr.; Eckert Seamans Cherin & Mellott, LLC

(57) ABSTRACT

A multi-step separator for a fuze is configured to be mated to an explosive device in a military munition, either at a production facility during manufacture of the munition or during use in the field. The fuze includes a detonator with a booster or spit-back element for initiating an energetic sequence resulting in a high-order detonation of the explosive device. The multi-step separator includes:

(a) a fuze-munition interface device for retaining the fuze in a confined, close relationship with the explosive device and for releasing the fuze when and if it is subjected to an external stimulus that may cause it to detonate the explosive device; and (b) a separating device for physically distancing the fuze from the explosive device when and if the fuze is released.

11 Claims, 13 Drawing Sheets

(51) Int. Cl.
*F42B 39/14* (2006.01)
*F42C 15/44* (2006.01)

(56) References Cited

U.S. PATENT DOCUMENTS 4,922,944 A * 5/1990 Mueller ..... F16K 17/383 137/72
5,035,181 A * 7/1991 Jacks ..... F42C 19/02 102/293
5,311,820 A * 5/1994 Ellingsen ..... F02K 9/343 102/481
7,331,292 B1 2/2008 Kim et al.
7,930,975 B2 * 4/2011 Cotet ..... F42C 19/02 102/202.1
8,505,458 B1 * 8/2013 Cannon ..... F42B 39/20 102/481
8,925,463 B1 1/2015 Sullivan et al.
2014/0211829 A1 * 7/2014 Nichols ..... G01K 11/02 374/159

* cited by examiner

MULTI-ACTION FUZE AND WARHEAD SEPARATOR FITTED TO A MUNITION

CROSS-REFERENCE TO RELATED APPLICATION

This application claims priority from Provisional Application No. 61/981,298, filed Apr. 18, 2014, entitled "TRIPLE ACTION VENT AND SUB-COMPONENT SEPARATOR."

BACKGROUND OF THE INVENTION

The present invention relates to a military munition of the type having an explosive warhead, and more particularly to a device for separating the warhead from fuze and the adjacent initiator, igniter, detonator, and/or spit-back device ("IIDS device") that initiates a warhead in a munition. The invention functions to avoid a dangerous condition where such a munition is exposed to external stimuli, such as heat, that could detonate the warhead.

Any munition having an explosive warhead, whether be a grenade, projectile or an assembled munition fitted to a projectile, must function as intended in states and modes of use within the NATO operational conditions:

A—Storage and Assembly to a Projectile,
B—Feeding,
C—Chambering,
D—Function fire,
E—Ballistic Flight,
F—Fuze Function and Detonation FIG. 1 provides a generic graphic presentation of the heat conditions encountered by munitions when functioning in their intended states and modes of use. When a munition has a long dwell time the chamber of a weapon, such as a gun or cannon, heat can be transferred from the barrel of the weapon to the projectile body. In longer dwell-time weapons, the projectile must remain intact to allow for proper ammunition function and heat flow must be attenuated to preclude inadvertent activation of the device. Shoulder launched munitions like the lightweight anti-armor weapon ("LAW") are housed in an expendable housing that eliminate the need for states and modes A-C as the munition is housed in a tube.

When munition such as an ammunition cartridge, shell or shoulder launched weapon are stored and when they mention is exposed to heat beyond identified storage conditions (normally in the range of 170° F.) the munitions are subject to premature detonation. For example, the heat generated by a fire increases over time and is generally over a much longer duration (compared to the heat of transferred into a cartridge when it is chambered and dwelling in a cannon barrel). Generally, in slow heating the 1$^{st}$ energetic event is deflagration of the powder. Conversely, in fast heating primers generally initiate ignition.

SUMMARY OF THE INVENTION

The present invention provides a mechanism for preventing an unwanted and dangerous detonation of a munition warhead during one of the NATO operational conditions.

When a munition is exposed to unsafe conditions—for example, to heat generated by a fire—the invention harnesses the increasing heat to initiate a dual or triple action vent that physically separates components improving the venting of energetic materials in a manner that precludes a warhead detonation.

A device according to the invention is incorporated into grenades or cartridge munitions and/or into the ammunition's packaging or storage container, a container that may include "dunnage" (dunnage being the internal packaging material in a munitions' container).

A device according to the invention is configured at the physical boundary or interface in a munition where (a) one sub-component includes a warhead containing an explosive and (b) a second sub-component houses the IIDS device that may include a fuse. The invention initiates a two or three step process uncoupling and separating these components at a critical time.

More particularly, the present invention provides a "multi-step separator" for a fuze configured to be mated to an explosive device in a military munition, either at a production facility during manufacture of the munition or during use in the field. The fuze includes a detonator with a booster or spit-back element for initiating an energetic sequence resulting in a high-order detonation of the explosive device. The multi-step separator includes:

(a) a fuze-munition interface device for retaining the fuze in a confined, close relationship with the explosive device and for releasing the fuze when and if it is subjected to an external stimulus that may cause it to detonate the explosive device; and (b) a separating device for physically distancing the fuze from the explosive device when and if the fuze is released.

One such external stimulus, which activates the separator device, is an elevated temperature, in particular about 160° C., above a range of operational temperatures within which the munition is designed to function. In this case the fuze-munition interface device preferably comprises a solid, fusible material that melts at the elevated temperature, releasing the fuze when it melts.

Alternatively or in addition, the fuze-munition interface device may comprise a shape memory material that changes shape at the elevated temperature, thus releasing the fuze when it changes shape.

According to a preferred embodiment of the invention, the separating device comprises a compressed spring interposed between said fuze and said explosive device. This compressed spring is preferably retained in a compressed state by a first solid, fusible material that melts at an elevated temperature thereby releasing the spring from compression. When and if released, the spring causes the fuze to physically distance itself from the explosive device in the munition.

Alternatively or in addition, the compressed spring is retained in a compressed state by a shape memory material that changes its shape at an elevated temperature thereby releasing the spring from compression.

In a particular, preferred embodiment, the multi-step separator device further comprises a retaining wire configured to allow rotation of the fuze, when and if the fuze is released.

The separator device may also include a housing for the detonator and a second solid, fusible material arranged to release the detonator from the housing when it melts. This second fusible material preferably has a melting temperature that is above the melting temperature of the first fusible material.

Advantageously the separator device further comprises an insulating material configured to guide the heat away from the first fusible material.

When the fuze is mated to an explosive device at a production facility, the munition is preferably packaged in a box that includes a void in the dunnage, allowing for the physical separation of the fuze from the explosive device. If desired the dunnage can be configured to retain an ammunition belt.

For a full understanding of the present invention, reference should now be made to the following detailed description of the preferred embodiments of the invention as illustrated in the accompanying drawings.

DETAILED DESCRIPTION OF PREFERRED EMBODIMENTS

The preferred embodiments of the present invention will now be described with reference to FIGS. 1-15*b* of the drawings.

Figure 1:
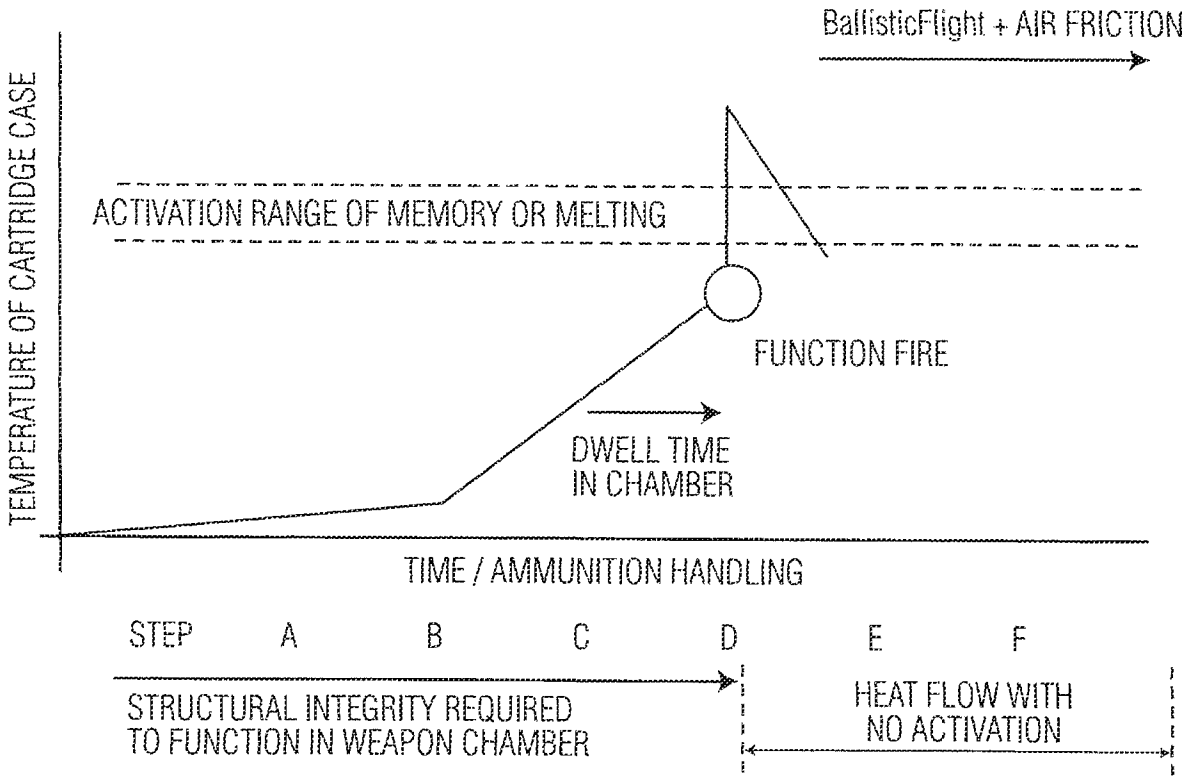
FIG. 1 is a time chart showing typical ammunition states and modes of use (temperature/time).
Figure 2A:
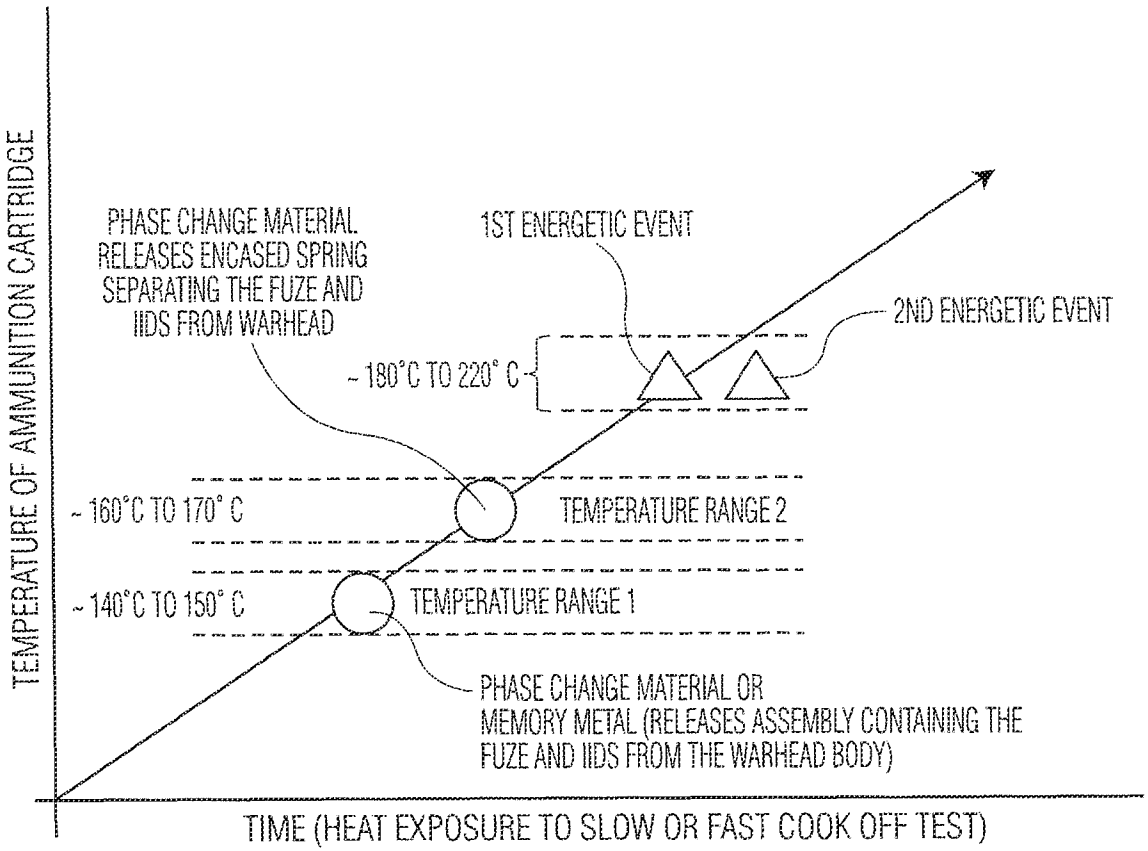
FIG. 2A depicts approximate activation temperature ranges for a two-step separator device.

In conditions of a fire, the two-step or three-step function of the invention allows for the eventual "low-order" deflagration of the explosive load and detonation of IIDS devices in conditions where the energetic events are not contained and where the IIDS device is separated from the warhead. FIG. 2A depicts the nominal activation temperature ranges for a two-step device and FIG. 2B depicts the nominal activation ranges for a three-step device.

As shown in FIG. 2A at the $1^{st}$ temperature threshold a phase change of a fusible material or memory metal releases the ogive (housing a fuze and an IIDS device) from the warhead. When the projectile (ogive and warhead), reaches the $2^{nd}$ elevated threshold temperature, a compressed spring is released and, when uncompressed, separates the ogive from the warhead.

Figure 2B:
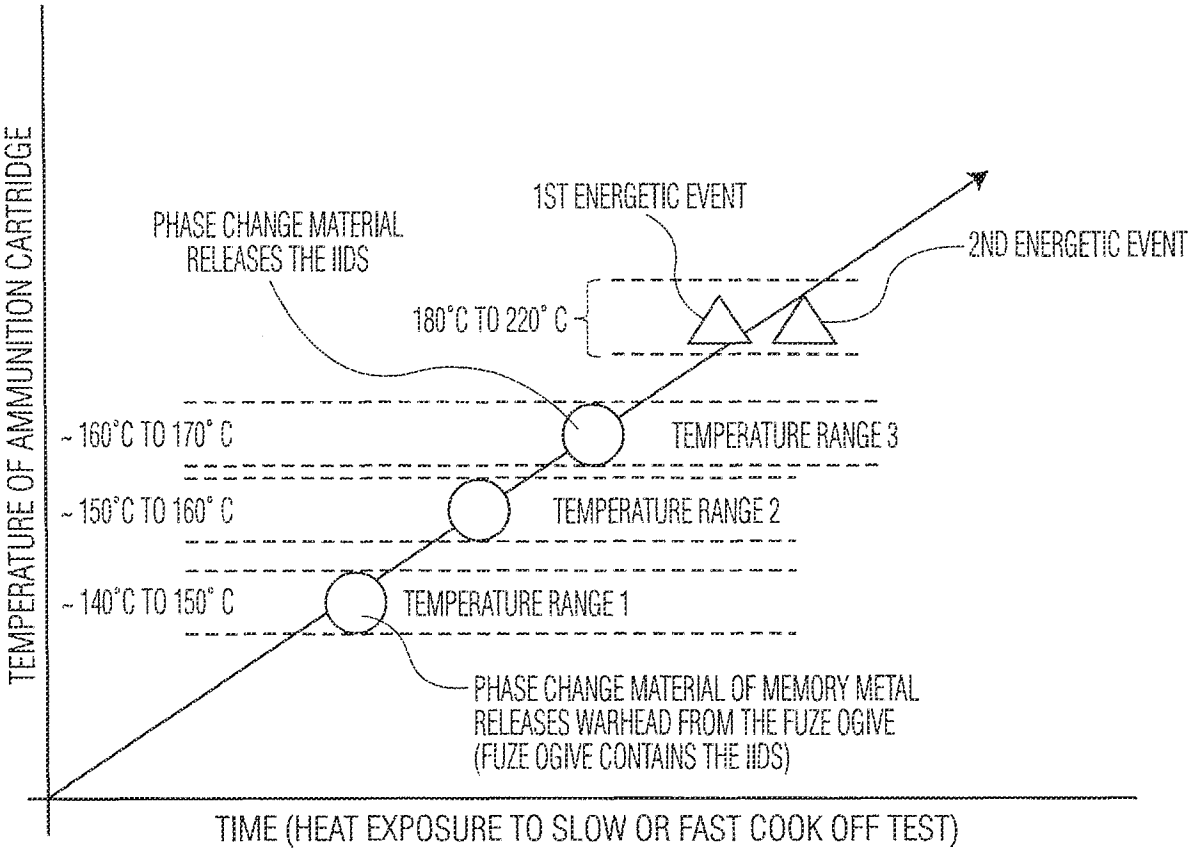
FIG. 2B depicts approximate activation temperature ranges for a three-step separator device.

As shown in FIG. 2B, in the $1^{st}$ and $2^{nd}$ phase, the device operates as described in 2A (above) and, when reaching a $3^{rd}$ temperature threshold, the IIDS device is released from the fuze.

Figure 3:
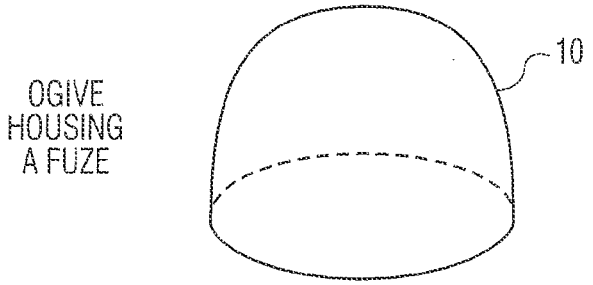
FIG. 3 depicts an ogive of a munition which houses a Safe and Arm device that includes a initiator, igniter, detonator and/or a spit-back device (IDDS device).
Figure 4:
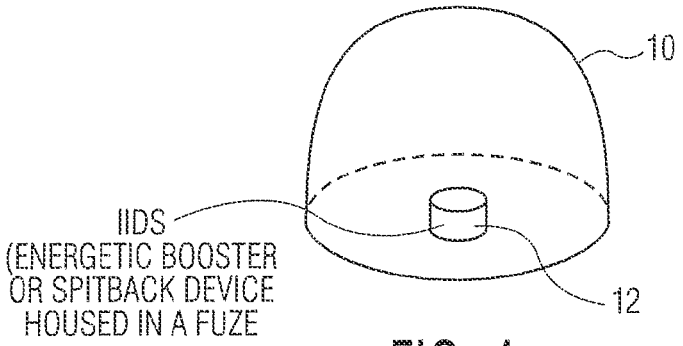
FIG. 4 depicts the IIDS device within the fuze (top perspective view).
Figure 5:
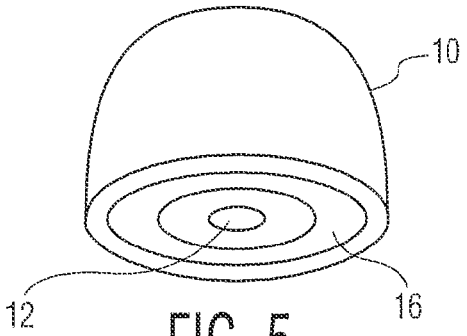
FIG. 5 depicts the IIDS device spring-fitted within the ogive (bottom view perspective).

Multi-Step Separator Elements: The structure and operation of the multi-step separator according to the present invention are illustrated in FIGS. 3-10. FIG. 3 shows the ogive portion 10 of a projectile having a warhead. The ogive includes a fuze with an IIDS device 12 (FIG. 4) mounted within a spring-ejection device (FIG. 5) as described below.

Figure 6:
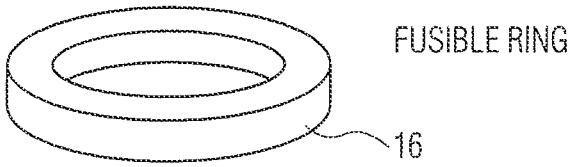
FIG. 6 depicts a circular fusible casing that houses a compressed spring.
Figure 7:
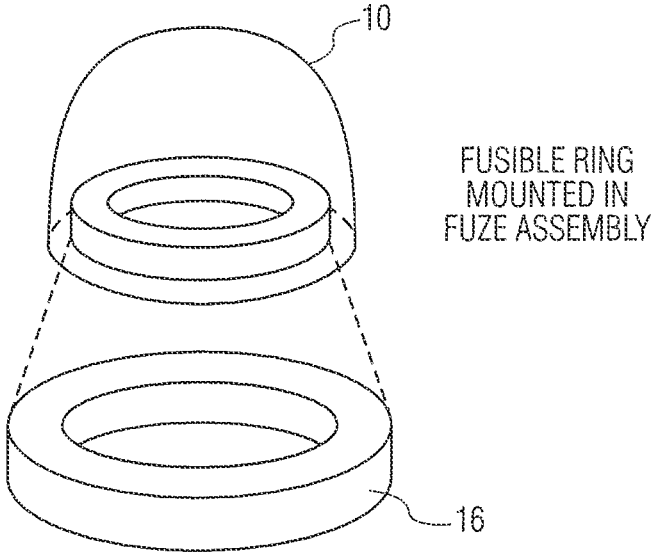
FIG. 7 depicts the circular casing of FIG. 6 within the ogive and an exploded view outside of the ogive.
Figure 8:
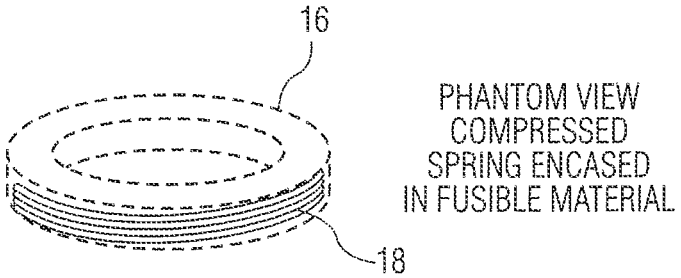
FIG. 8 depicts a compressed spring encased in a fusible material.
Figure 9:
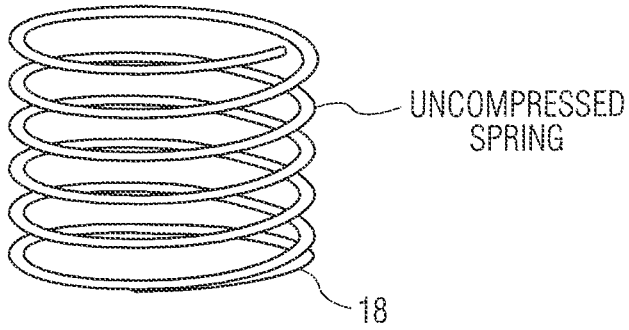
FIG. 9 depicts an uncompressed spring freed from the fusible casing.

FIG. 6 shows a ring 16 made of a fusible metal alloy or plastic material designed to melt at an elevated temperature above the temperature at which the munition is designed to detonate at about 160° C. for example, as indicated in FIGS. 2A and 2B. This ring surrounds the IIDS device which is mounted in the ogive, as illustrated in FIG. 7.

Figure 10:
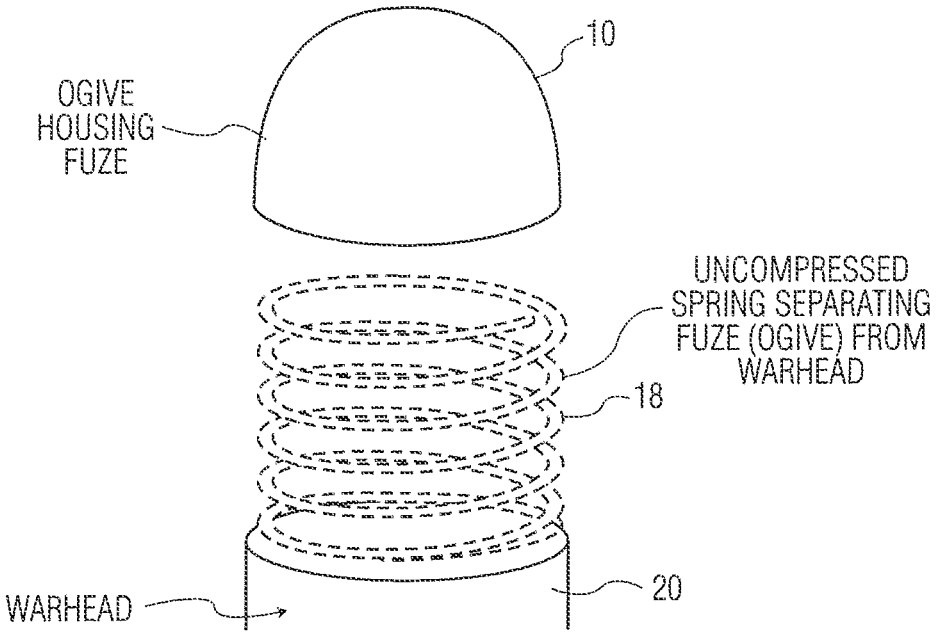
FIG. 10 depicts the uncompressed spring of FIG. 9 separating the ogive (containing the Safe and Arm device and fuze) from the warhead body.
Figure 11A:
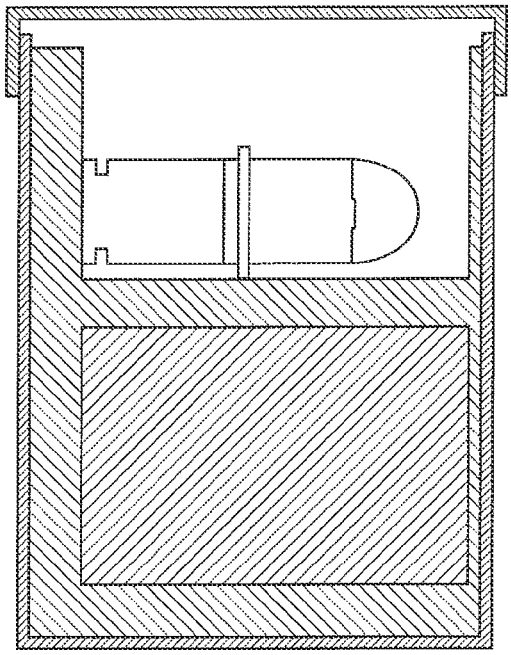
FIG. 11*a* shows a cut-away view of ammunition in a UN munition container.
Figure 11B:
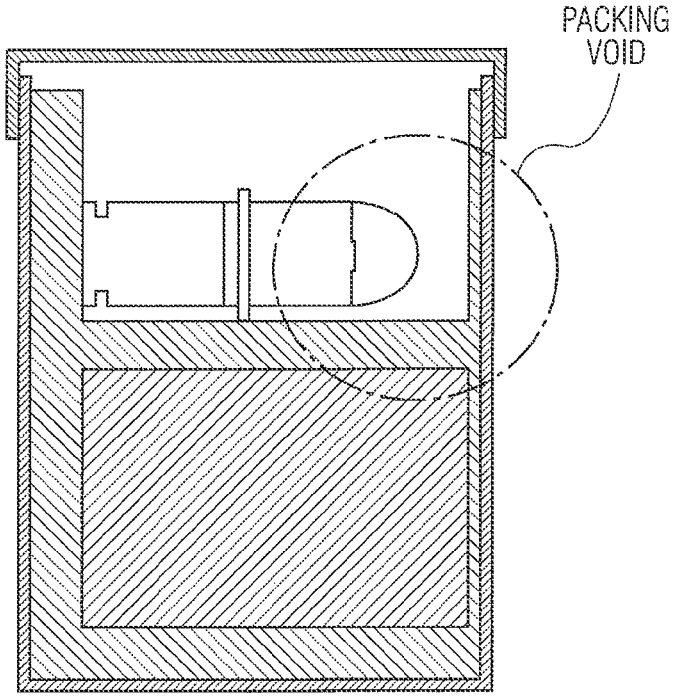
FIG. 11*b* shows a cut-away view of ammunition in a UN munition container illustrating a void feature.
Figure 11C:
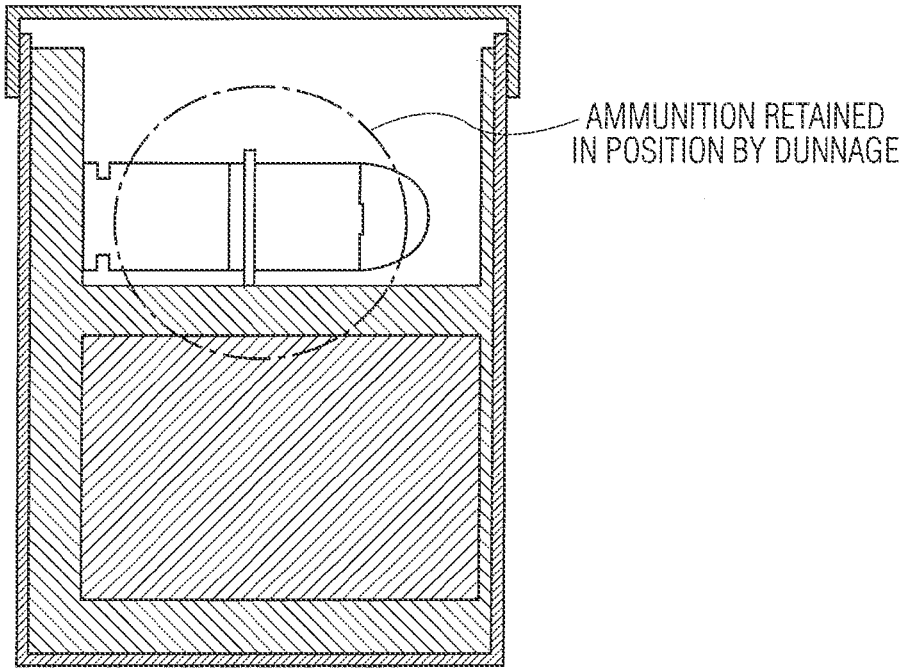
FIG. 11*c* shows a cut-away view of ammunition in a UN munition container illustrating dunnage with a retaining feature.
Figure 11D:
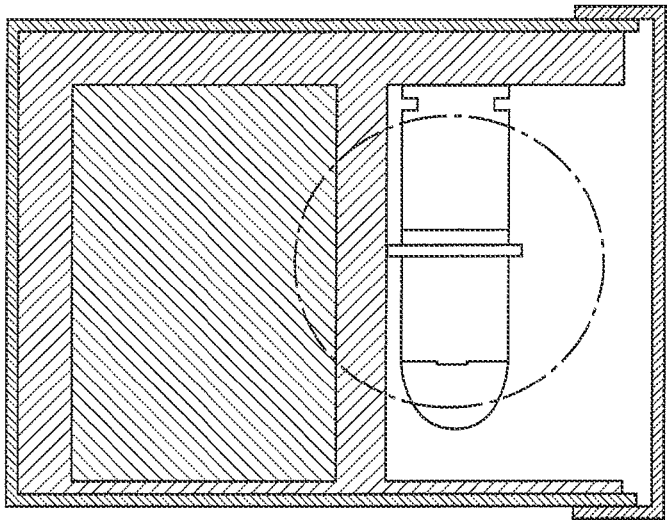
FIG. 11*d* shows a cut-away view of ammunition in a UN munition container illustrating the orientation of ammunition.
Figure 11E:
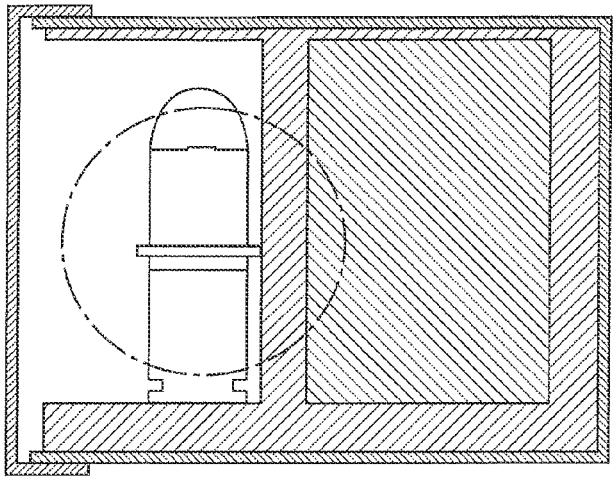
FIG. 11*e* shows a cut-away view of ammunition in a UN munition container illustrating an orientation change in the ammunition.
Figure 12:
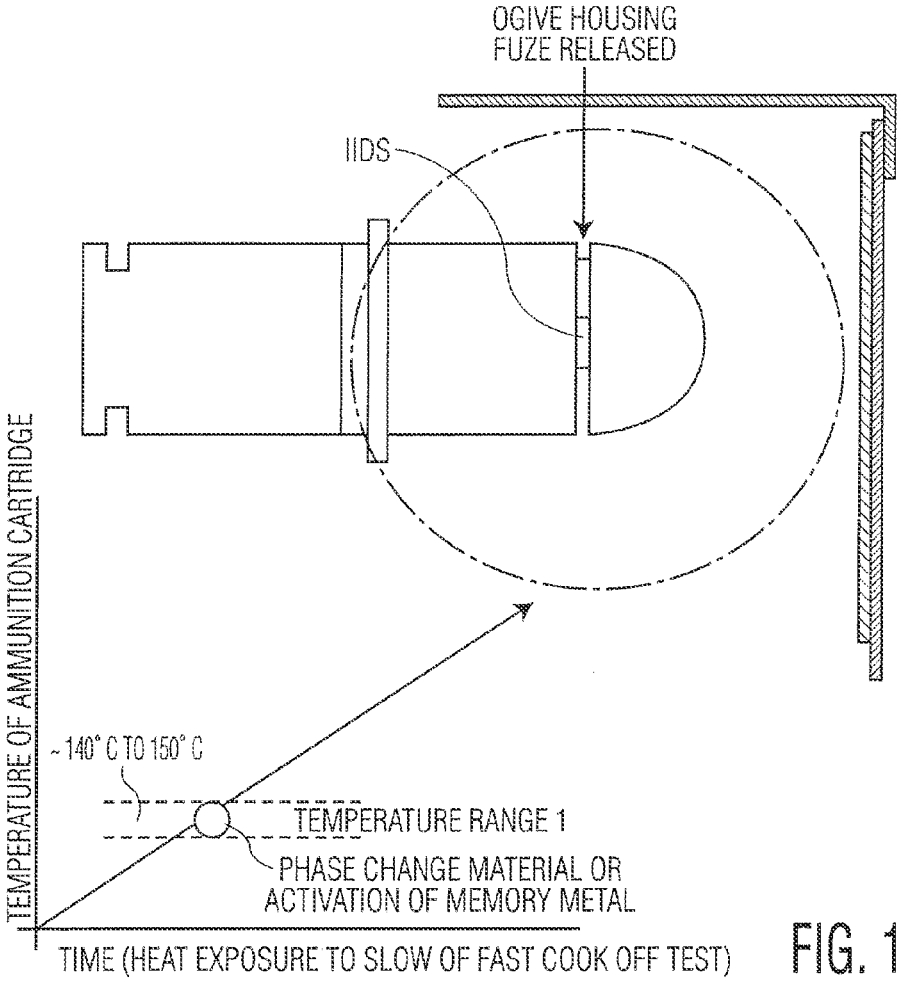
FIG. 12 depicts a heat exposure mode for a munition which initiates separation of warhead and an IIDS device (Temperature Range 1) referenced in FIGS. 2*a* and 2*b*.
Figure 13:
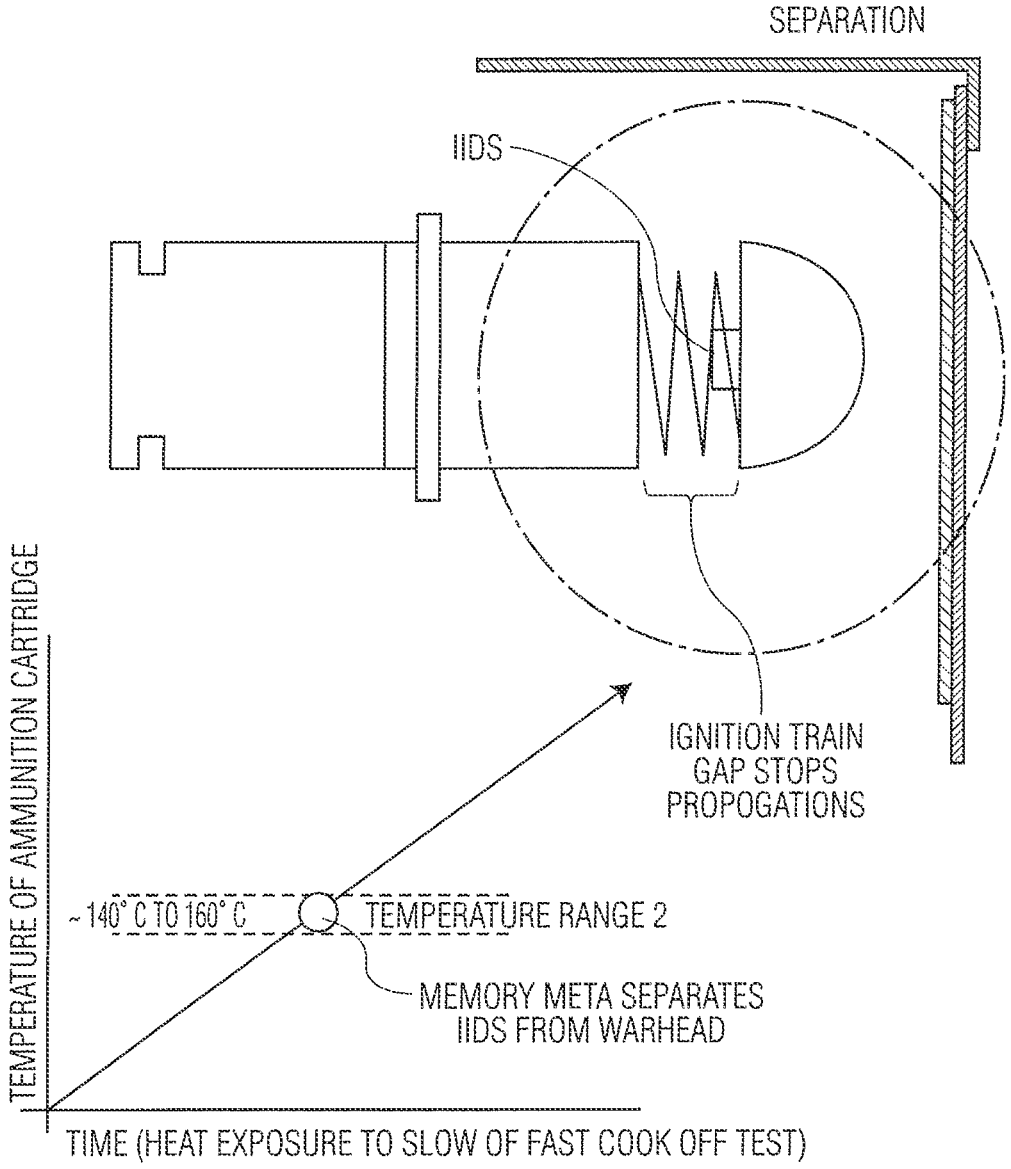
FIG. 13 depicts a heat exposure mode for a munition which initiates segregation of the IIDS device (Temperature Range 2) from the warhead. The gap created by release of the uncompressed spring is adequate to halt any propagation of an explosive chain.

Embedded in the fusible ring 16 is a compressed spring 18 (FIGS. 8 and 9) which is released when the fusible material melts (FIG. 10).

Packaging or Storage: Ammunition uses UN packaging (see FIG. 11*a*). A void in the packing container (or container's dunnage) allows the ammunition component housing the IIDS to separate, physically segregate and vent a deflagrating explosion, thereby preventing a detonation event (see FIG. 11*b*). The void must provide for an unobstructed volume in all approved UN stacking configurations. The packaging is configured to retain (linked or unlinked) ammunition in position, while providing adequate unobstructed volume allowing for ammunition sub-components to separate (see FIG. 11*c*). Where spit-back charges are utilized, the void provides for separation and rotation of the IIDS device. The package, dunnage and retention configuration works in multiple orientations (see FIGS. 11*d* and 11*e*).

Separation: When exposed to heat in a specified range (Temperature Range 1) the sub-components are released from each other. This is accomplished by (a) use of either a memory metal that unfastens the loaded warhead from the component housing the IIDS or (b) use of a fusable material that loses its physical strength (see FIG. 12).

Segregation: When the heat increases to a higher range (Temperature Range 2) the sub-component pushes the sub-components apart creating adequate segregation (void) between the warhead (see FIG. 13). In the event of a fire, the initiators, igniters and boosters vent into the packaging box (see next paragraph regarding spit-back).

Rotation or Compromised Spit-back Integrity: When the IDDS includes a spit-back device, it is also necessary to make sure that a spit-back jet does not initiate the warhead. Accordingly, at Temperature Range 3 (a) a rotation is induced by so that the device is not aligned to generate a jet that would impact on the explosive or alternatively, (b) the spit-back device in the ogive is held in place at temperatures below Temperature Range 3. A housing fabricated from a memory metal or fusible material frees the IIDS device from the ogive at temperatures above Temperature Range 3 so that a focused spit-back jet does not hit the warhead (see FIGS. 15*a* and 15*b*).

Figure 14:
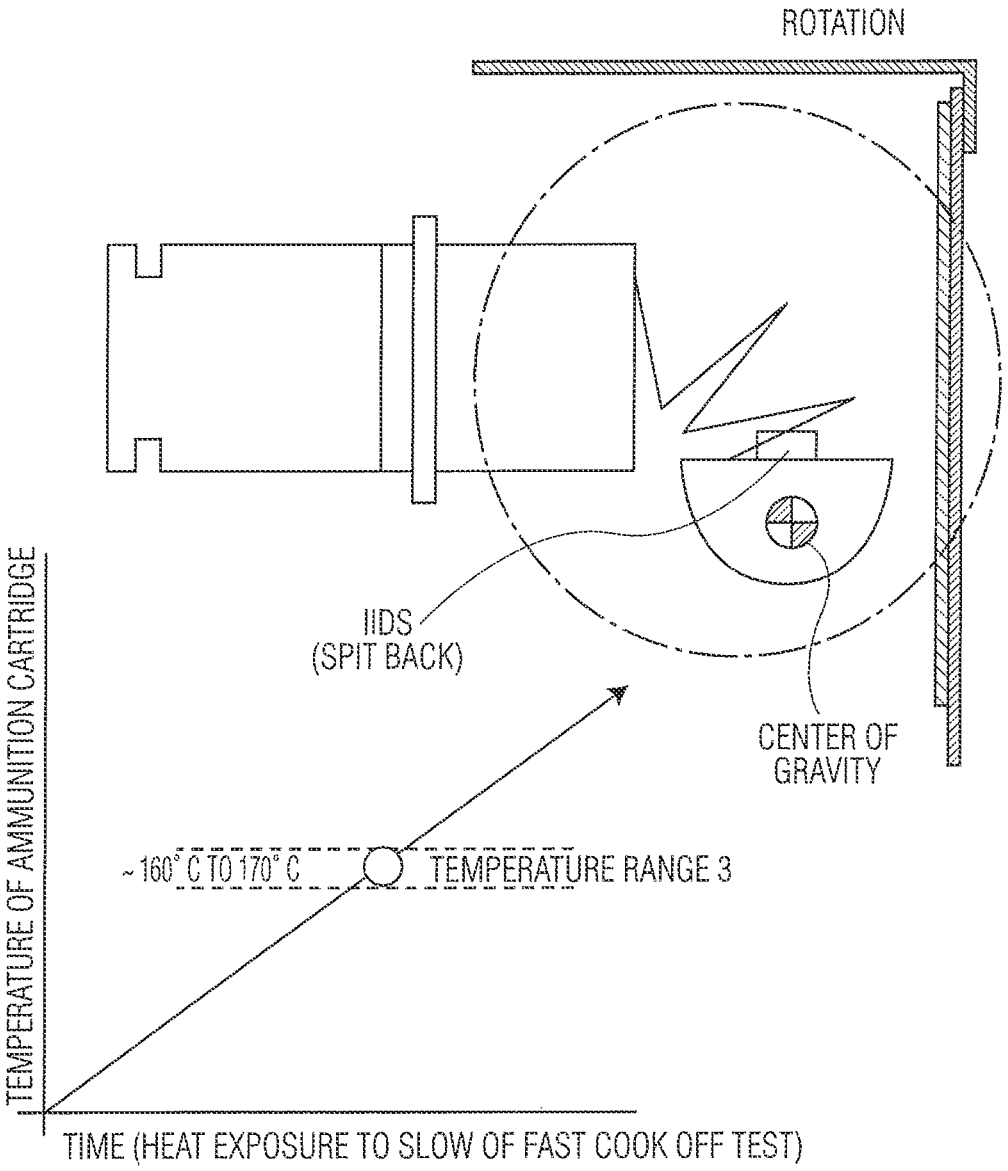
FIG. 14 depicts a heat exposure mode for a munition which initiates rotation of the IIDS device with a spit-back device (Temperature Range 3).
Figure 15A:
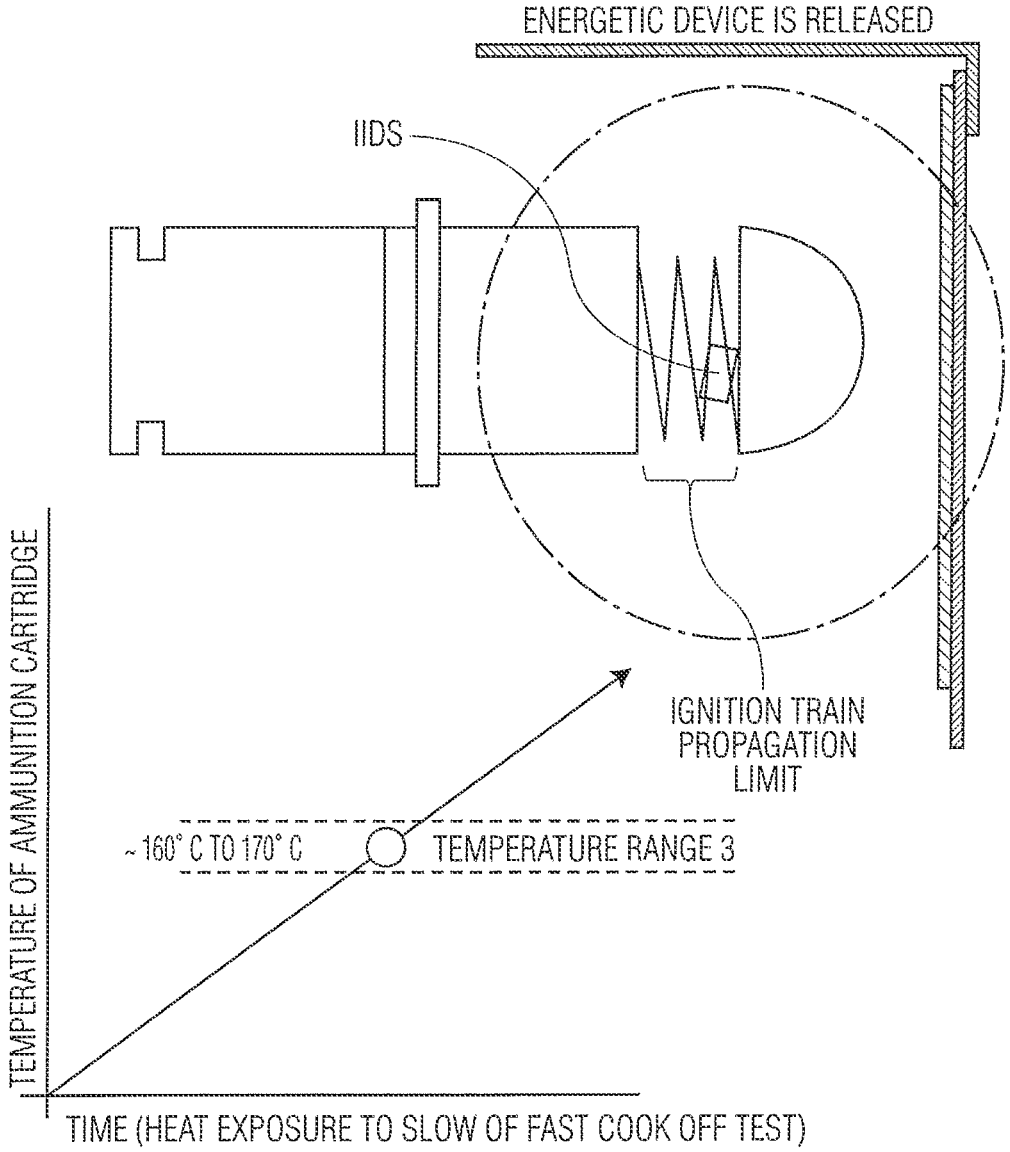
FIG. 15*a* depicts a heat exposure mode for a munition which initiates separation of a spit-back device from a component housing an IIDS device (Temperature Range 3).
Figure 15B:
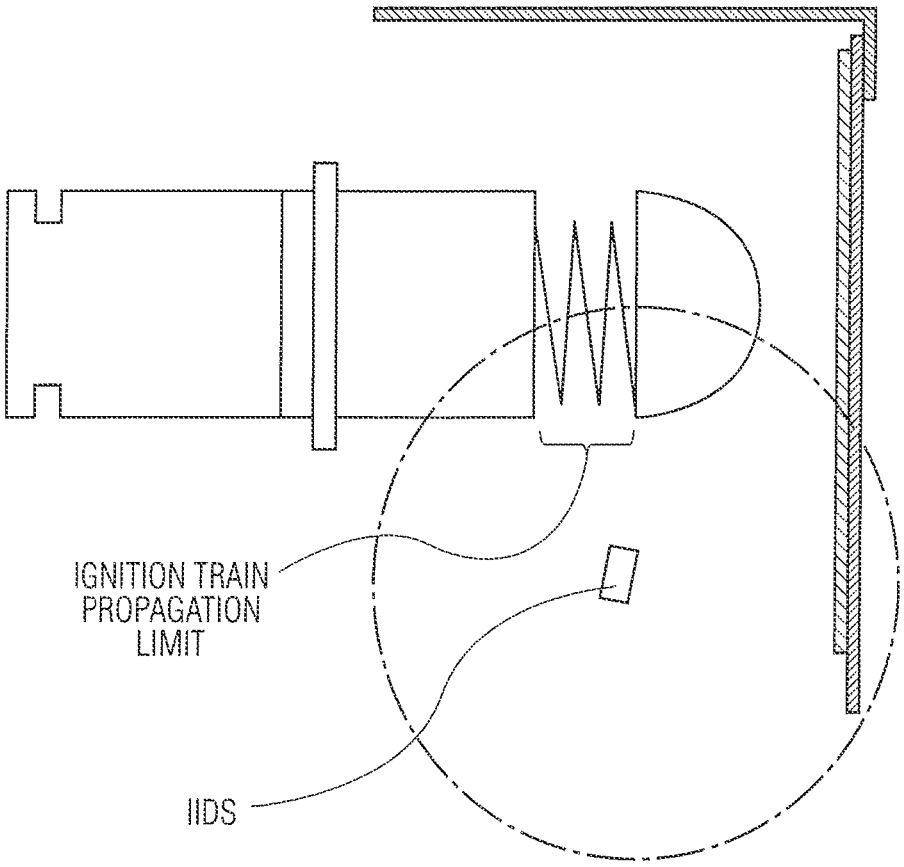
FIG. 15*b* depicts a heat exposure mode for a munition in which the spit-back device is dislodged allowing a spit-back device to drop free of an ogive.

In these conditions the device either rotates the sub-component within a packaged container or the IDSS device is released from a housing comprised of a fusible material or memory metal (see FIG. 14).

Inclusion of Insulators: The device must function in a normal environment that does include exposure to heat in chambering, and from air friction in ballistic flight. Therefore, the inactivated memory metal or solid fusible material must be encased and fitted within the munition so that heat is attenuated in normal function conditions that may include chambering into a weapon's barrel or in a normal ballistic flight. However, in conditions outside of the barrel where the fuze is attached the warhead, the device shall activate sequentially releasing the fuze and IIDS from the warhead.

There has thus been shown and described a novel military munition which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A multi-step separator for a fuze that is configured to be disposed in an ogive of a projectile in a cartridge-type military munition, wherein the fuze includes a detonator for initiating an energetic sequence resulting in a high-order detonation of an explosive device in the projectile, said multi-step separator comprising a fuze-munition interface device for retaining the fuze in a confined, close relationship with the explosive device and for releasing the fuze when and if it is subjected to a first elevated temperature that may cause it to prematurely detonate the explosive device, said interface device comprising a separating device including a fusible ring disposed between the fuze and the explosive device for separating and physically distancing the fuze from the explosive device when and if the fuze is released at said first elevated temperature, wherein said fusible ring comprises a compressed coil spring embedded in a first solid, fusible material that melts at said elevated temperature and releases the spring when it melts.

2. The multi-step separator for a fuze as defined in claim 1, wherein the first elevated temperature above a range of operational temperatures within which the munition is designed to function.

3. The multi-step separator for a fuze as defined in claim 2, wherein said first elevated temperature is about 160° C.

4. The multi-step separator for a fuze as defined in claim 1, further comprising a housing for said detonator and wherein said fuze-munition interface device further comprises a second solid, fusible material that melts at a second elevated temperature, lower than said first elevated temperature, said second solid, fusible material releasing the fuze from the housing when it melts.

5. The multi-step separator for a fuze as defined in claim 1, further comprising a housing for said detonator and wherein said fuze-munition interface device further comprises a shape memory material that changes shape at a second elevated temperature, lower than said first elevated temperature, said shape memory material releasing the fuze from the housing when it changes shape.

6. The multi-step separator for a fuze as defined in claim 1, further comprising a retaining wire configured to allow rotation of the fuze when and if the fuze is released.

7. The multistep separator for a fuze as defined in claim 1, further comprising a housing for said detonator, wherein said detonator comprises a booster or spit-back element for initiating said energetic sequence and said fuze-munition interface device further comprises a third solid, fusible material arranged to release the booster or spit-back element from the housing when it melts, said third fusible material that melts at a third elevated temperature that is above the melting temperature of the first fusible material.

8. The multi-step separator for a fuze as defined in claim 7, further comprising an insulating material configured to guide heat away from the third fusible material.

9. The multi-step separator for a fuze as defined in claim 1, further comprising an insulating material configured to guide heat away from the first fusible material.

10. The multi-step separator for a fuze as defined in claim 1, wherein, when the fuze is mated to an explosive device at a production facility, the munition is packaged in a box that includes a void in the dunnage allowing for physical separation of the fuze from the explosive device.

11. The multi-step separator for a fuze as defined in claim 1, wherein, when the fuze is mated to an explosive device at a production facility and the munition is packaged in a box that includes a void in the dunnage allowing for physical separation of the fuze from the explosive device, the dunnage is configured to retain an ammunition belt.

* * * * *